United States Patent [19]

Marti et al.

[11] 3,963,069

[45] June 15, 1976

[54] ROLLER APRON FRAMEWORK FOR SUPPORT- OR DRIVE ROLLS OF A CONTINUOUS CASTING INSTALLATION

[75] Inventors: Heinrich Marti, Forch; Markus Schmid, Zurich, both of Switzerland

[73] Assignee: Concast AG, Zurich, Switzerland

[22] Filed: Aug. 4, 1975

[21] Appl. No.: 601,614

[30] Foreign Application Priority Data

Aug. 16, 1974 Switzerland ..... 11225/74

[52] U.S. Cl. ..... 164/282; 72/251

[51] Int. Cl.[2] ..... B22D 11/12

[58] Field of Search ..... 164/282; 72/251

[56] References Cited

UNITED STATES PATENTS 3,722,576 3/1973 Gallucci ..... 164/282

3,867,827 2/1975 Backhaus et al. ..... 164/282 X

*Primary Examiner*—Travis S. McGehee

*Attorney, Agent, or Firm*—Werner W. Kleeman

[57] ABSTRACT

A roller apron framework for support- or drive rolls of a continuous casting installation wherein at least at one strand guide path each two rollers or rolls which follow one another in the direction of travel of the continuously cast strand are mounted in a common pivotal yoke and such yoke can be moved by piston-cylinder units substantially transversely with respect to the guided surface of the strand. The yoke is provided with impact surfaces and can be applied by means of the piston-cylinder units against support surfaces associated with each roller, the support surfaces being arranged at a stationary frame and limiting the path of application or adjustment of the rollers at the strand.

8 Claims, 4 Drawing Figures

Fig. 1
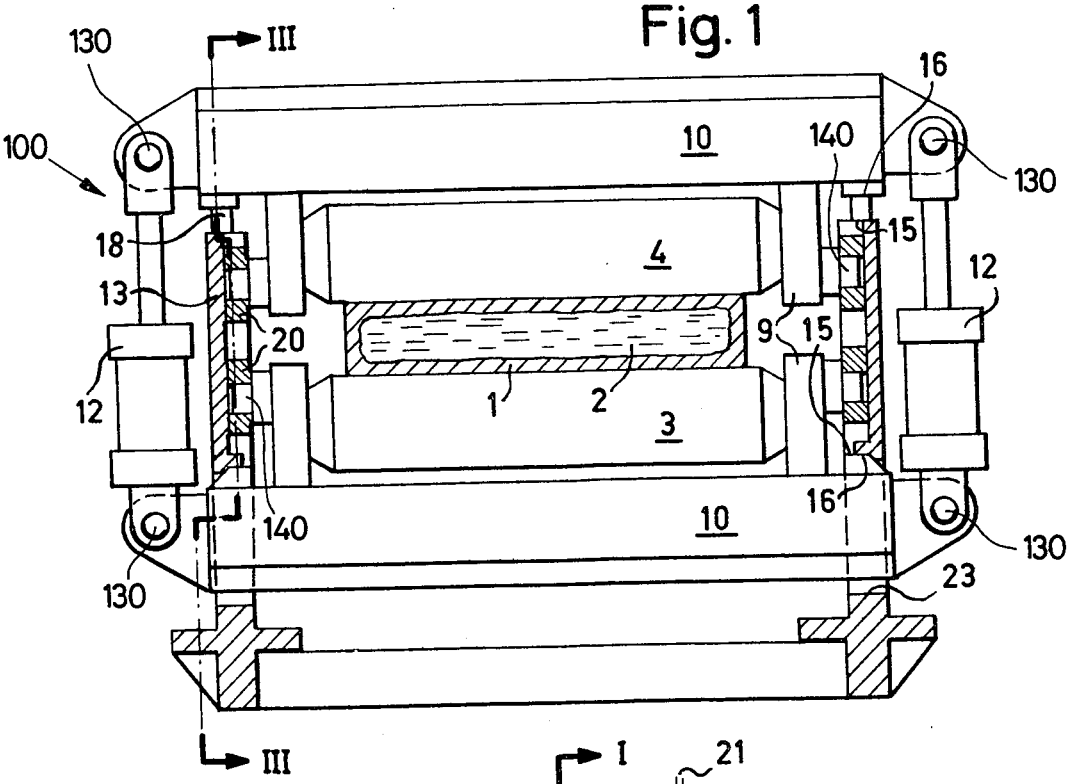
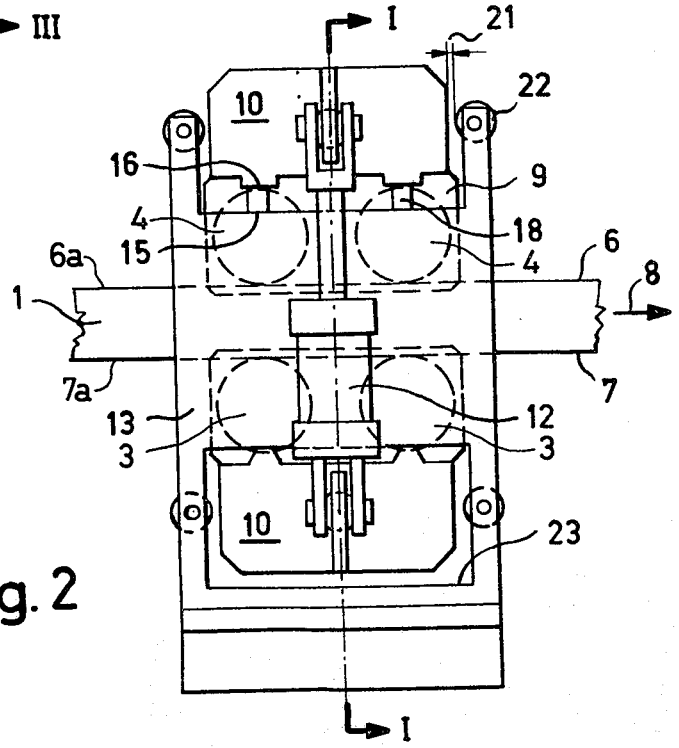
Fig. 2

ROLLER APRON FRAMEWORK FOR SUPPORT- OR DRIVE ROLLS OF A CONTINUOUS CASTING INSTALLATION

BACKGROUND OF THE INVENTION

The present invention relates to a new and improved roller apron framework for support- or drive rolls of a continuous casting installation or plant, wherein at least at one strand guide pat there are mounted in a common pivotable yoke two respective rollers following one another in the direction of strand travel, and such yoke can be moved by means of piston-cylinder units along guides substantially transversely with respect to the guided strand surface.

In the continuous casting art there are frequently used rollers which can be hydraulically adjusted or applied to the strand for the purpose of supporting and guiding the strand and for driving and linearly straightening curved or arcuate strands, especially steel strands possessing a liquid core. These rollers can be applied individually or in the form of assembled together groups of rollers.

It is already known in this particular field of technology to connect to a common yoke two rollers which are successively arranged in the direction of strand travel and to pivotably connect this yoke with an adjustment drive arranged between both rollers and acting transversely with respect to the guided strand surface. If unequal force components act upon such rollers arranged in a yoke, and which force components are directed tranversely with respect to the guided strand surface, then by means of the pivot axis or shaft of the yoke these force components are uniformly divided at both rollers. However, in addition to the force components acting transversely with respect to the guided strand surface there are further applied to the rollers force components which are also directed parallel to the guided strand surface due to the presence of bending- and drive forces and irregularities present at the casting or strand. These last-mentioned force components produce a tilting moment at the yoke, and thus disturb the uniform force distribution of the adjustment or contact force at both rollers arranged in the yoke. On the one hand, owing to uncontrolled and non-uniform adjustment forces and on the other hand, due to possible pivotal movement of the one roller past a pre-determined guide path line or boundary towards the strand, there can be caused strand flaws or defects and/or undesired roller flattening or the like. Moreover, there is not always insured for protection against over-loading of the rollers connected with the yoke, notwithstanding the pivotability of the yoke. Additionally, with such roller apron frameworks it is not possible to control the guide paths for the strand of the roller apron, for instance with the aid of calipers or gauges or by means of a measurement carriage or the like which can be introduced into the roller apron.

SUMMARY OF THE INVENTION

Hence, with the foregoing in mind it is a primary object of the present invention to provide a new and improved roller apron framework which is not associated with the aforementioned drawbacks and limitations of the prior art proposals.

Another and more specific object of the present invention is concerned with the provision of a new and improved construction of roller aprom framework for support- or drive rollers based upon the principle of a twin-roller yoke wherein each individual roller can take-up force components directed parallel to the guided strand surface without undesirably effecting the strand, each roller is protected against overload, and the strand guide path of such framework can be adjusted and controlled with small dimensional tolerances.

A still further object of the present invention aims at the provision of a roller apron framework of the type generally discussed which is extremely simple in construction and economical to manufacture and obtain.

Now in order to implement these and still further objects of the invention, which will become more readily apparent as the description proceeds, the roller apron framework of this development is manifested by the features that the yoke which is provided with impact or stop surfaces can be applied by means of the piston-cylinder units in the direction of support surfaces associated with each roller and arranged at a stationary frame, these support surfaces limiting the path of application of the rollers at the strand.

When using the roller apron framework of this development it is possible for each roll or roller to be able to deviate in the event of the presence of a load which is greater than its predetermined adjustment or application force, independent of the adjustment force and the adjustment path of the other rollers. The rollers or rolls and their bearings are thus effectively protected by virtue of these measures, so that, on the one hand, there is maintained the accuracy of the framework throughout longer operating times and, on the other hand, there can be considerably increased the longevity or service life of such rollers. A further advantage realized due to this construction resides in the fact that there is an improvement in the quality of the strand with regard to both surface- and internal flaws and also the accuracy of the thickness of the strand shell or skin. Furthermore, strand guide frameworks or roller apron frameworks constructed according to the present invention allow for a positive checking or control of the guide path with the aid of gauges and so forth.

In certain cases it may be desired that the rollers of both oppositely situated guide paths of a roller apron are protected against overload. An example of such is constituted by a continuous casting installation equipped with a straight mold and a short straight roller apron followed by an arcuate-shaped roller apron. With such casting installations possessing different characteristics of the curve of the path of travel of the strand there prevails the additional requirement of conveying colder straight strand ends through an arcuate- or arc-shaped roller apron without thereby damaging the rollers. But also in the case of arc-type continuous casting installations at least at the region of the straightening machine it is desirable to safeguard the rollers of both guide paths against overload. According to a further aspect of the invention this can be realized if two neighboring yokes arranged at oppositely situated strand guide paths are hingedly connected with the piston-cylinder units to both sides of the laterally arranged roll bearings. Such a supporting roller apron framework constitutes a simple and economical construction because it is possible, with one respective hydraulic cylinder arrangement or unit at each side, to apply four rollers, so that each roller is individually protected against overload.

If there are required short adjustment times for different strand thicknesses in a continuous casting installation, then, according to a particular further facet of the invention there can be employed exchangeable intermediate elements or parts between the support or supportng surfaces and the impact surfaces at the yoke, and which intermediate elements determine the spacing of the oppositely situated guide paths.

In order to take-up the force components effective at the rollers in the direction of travel of the strand, it is advantageous according to a further feature of the invention if, between the rollers connected with the yoke, a sliding block is guided in the frame transversely with respect to the direction of travel of the strand, such sliding block being hingedly connected with the roll bearings. In this way there is achieved the beneficial result that the force components acting essentially parallel to the guided strand surface are transmitted along the shortest possible path to the frame.

Depending upon the position of the sliding block guide and the dimensioning of the yoke it is possible in the case of vertical, arc-shaped or inclined extending roller aprons, upon opening of the roller apron framework, that there is present a tilting movement brought about by the position of the center of gravity of the yoke. In order to limit such tilting movement it is advantageous if there are provided at the frame and at the yokes coacting guide means which limit such tiltng movement of the yokes upon opening the framework.

The overloading of a roller is eliminated due to the possibility of deviation or departure of this roller away from the predetermined strand guide path line. As a result the yoke pivots. In order to be able to hold the second roller arranged in the yoke in its reference position with as small as possible tolerances during the pivotal movement, a further feature of the invention contemplates that the central axis of each of the rollers extending transversely with respect to the guide path and the central axis of each of the impact surfaces extending in the same direction can be each located in one respective plane. A further optimization of such tolerance can be achieved if the supporting- or the impact surfaces are curved or arcuate.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a vertical sectional view of a roller apron framework for support- or drive rollers, designed according to the present invention, and taken substantially along the line I—I of the showing of FIG. 2;

FIG. 2 is a side view of a partially illustrated roller apron framework constructed according to the present invention;

DETAILED DESCRIPTION OF THE PREFERRED EMBODIMENTS

Figure 3:
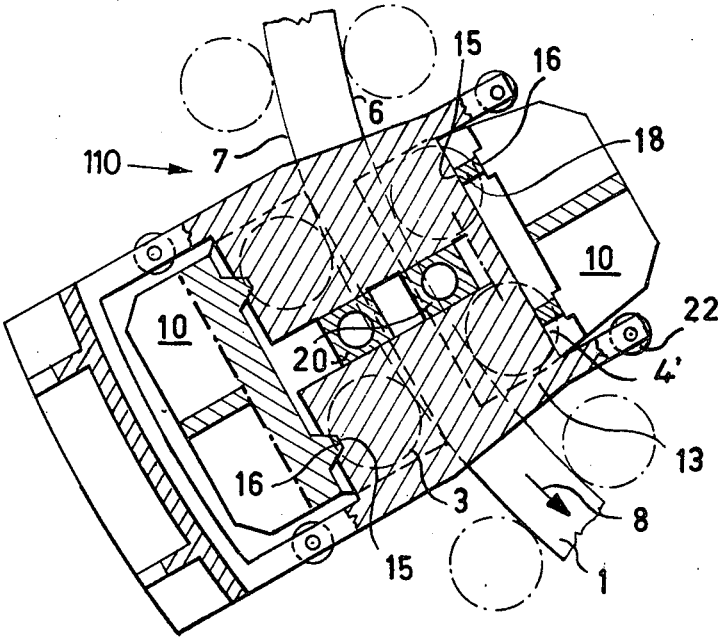
FIG. 3 is a cross-sectional view taken along the line III—III of FIG. 1, this framework being illustrated in the curved or arcuate portion of a roller apron.

Describing now the drawings, it is to be understood that only enough of the continuous casting installation or plant has been portrayed in the drawings in order to enable those skilled in the art to readily understand the underlying concepts of the present invention. Hence, by referring to FIGS. 1 to 3 it will be seen that in a roller apron framework or strand guide framework, generally designated by reference character 100, —hereinafter usually conveniently simply referred to as a roller apron framework— there is guided a cast strand 1 still having a liquid core 2 between lower rollers 3 and upper rollers 4. The planes 6a and 7a containing the guided outer portions or surfaces of the strand 1 form the guide paths or tracks 6 and 7, respectively, reference character 6 designating the upper guide path and reference character 7 the lower guide path. In the example under discussion the roller bearings 9 of each two respective rollers 3 or 4 which follow one another in the direction of travel 8 of the strand 1 of the upper and lower guide paths 6 and 7 are connected with a common pivotable yoke 10. However, it also would be possible for instance that only the upper rollers 4 are arranged in such a yoke 10 and the lower rollers 3 are arranged to be individually displaceable in known manner. Such solution is advantageously employed when such roller apron framework constitutes components of strand drive machines. They can be equipped with or without driven rollers. The yokes 10 are arranged to be movable transversely and essentially at right angles to the guide paths 6 and 7 by means of conventional piston-cylinder units 12. For each roller 3 and 4 there are mounted at a stationary frame 13 support or supporting surfaces 15 and impact or stop surfaces 16 at the yokes 10. The manually coacting impact or stop surfaces 16 and support surfaces 15 limit the path of displacement or adjustment of the rollers 3, 4 at the strand 1. The piston-cylinder units 12 arranged laterally of the roller bearings 9, in the exemplary embodiment under discussion, hingedly interconnect two yokes 10 arranged neighboring one another at oppositely situated guide paths 6,7. By means of exchangeable intermediate elements or pieces 18, which can be inserted between the support or supporting surfaces 15 and the impact surfaces 16, it is possible to change the spacing of the oppositely situated guide paths 6 and 7 for changes in the format or shape of the strand 1.

At the bearings 9 conveniently secured to the associated yoke 10 there is pivotably connected, as indicated by the pivot means 140, at each side of the strand 1 a sliding block 20 and guided in the stationary frame 13 transversely with respect to the strand guide paths 6 and 7. The stationary frame or frame means 13 is additionally provided with guide means in the form of rollers 22 which coact with the yokes 10. These rollers 22 only guide the yokes 10 upon opening of the framework 100, and the tilting movement of each yoke 10 is thus limited. In the closed or operating condition of the system there is provided a sufficiently large free intermediate space 21 between these guide rollers 22 and the yokes 10, so that each yoke can pivot during the casting operation.

If, for instance, for a change in the strand thickness the roller apron framework 100 is opened by the piston-cylinder units 12, then initially the lower yoke 10 raises from the supporting or support surfaces 15 and bears upon a surface 23 of the stationary frame. Thereafter, the upper yoke 10 raises-off the supporting surfaces 15 and the intermediate pieces or elements 18 can be exchanged. The framework 100 is again closed with the reverse sequence of steps.

In FIG. 3 there is illustrated a roller apron segment 110 containing one yoke 10 for each guide track or path 6, 7. Depending upon the construction of the roller apron it can be advantageous to arrange per segment and guide path a number of yokes 10.

Figure 4:
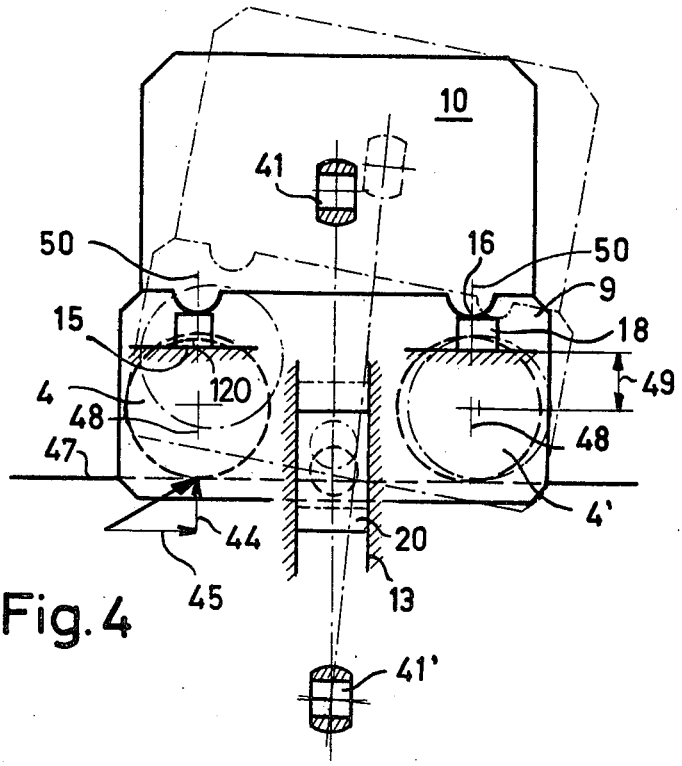
FIG. 4 schematically illustrates the function of the pivot geometry of such roller apron framework.

In FIG. 4 there is illustrated with full-lines a yoke 10 provided with the rollers 4, 4' in a reference- or set-position and with phantom-lines the same in a pivoted or rocked position. By means of the hatching or shading there has been indicated in section the stationary frame 13. The exchangeable intermediate pieces or spacer elements 18 are inserted between the support surfaces 15 and the impact or stop surfaces 16. Just as was the case for the arrangement of FIGS. 1 to 3 each sliding block 20 is connected with the roll bearings 9. Between ball-and-socket joints 41 and 41' there are hingedly connected the here not particularly illustrated piston-cylinder units at least at one yoke 10.

If the roller 4 arranged at the left-hand side of the showing is acted upon by a force component 44 transversely with respect to the guided strand surface and by a force component 45 acting essentially parallel to the guided strand surface, then the yoke 10 rocks about a pivot axis at the region of the stop or impact surfaces 16. With this embodiment, the force of the component 44 is greater than the predetermined contact or application force of the rollers 4. The sliding block 20 is displaced upwardly into the phantom-line position and takes-up the forces of the force component 45 acting parallel to the guided strand surface. The roller 4' illustrated at the righthand side of the drawing in this exemplary embodiment, is shifted somewhat towards the right, without however practically deviating to a measurable extent from the predetermined adjustment or application force or the predetermined guide path 47. The central axis 48 of the rollers 4,4' extending essentially transverse to the guide path 47 and the central axis 50 of the impact surfaces 16 extending in the same direction are located in one plane when both impact surfaces 16 bear against the support or supporting surfaces 15. As concerns the geometry of the pivotal movement there is not only decisive the mutual position of the central axes 48 and 50 of the rollers 4, 4' and the stop or impact surfaces 16, respectively. Also a spacing 49 between the support surfaces 15 and the roller axis located parallel to the guide path track can be advantageously selected to amount to a minimum. Moreover, the stop or impact surfaces 16 of the yoke 10 in this exemplary arrangement are constructed to be arcuate-shaped. Equally, the support surfaces 15 can be arcuate-shaped as schematically indicated by reference character 120 in phantom lines at the left-side of FIG. 4.

In FIGS. 1 to 4 and as previously explained the piston-cylinder units 12 are hingedly connected or articulated at the yokes 10 as generally indicated by reference character 130. As a variant embodiment, it can be advantageous to extend the pins of the sliding blocks in such a manner that they penetrate through the associated frame 13 and are directly connected with the associated piston-cylinder unit 12. The position of the piston-cylinder units 12 with such solution always remains transversely with respect to the guide path. The hydraulically or pneumatically cushioned or shock absorbed predetermined adjustment or contact force of the rollers also can be produced by other force-applying devices, such as for instance sets or packages of springs or other appropriate structure.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. A roller apron framework for support- or drive rolls of a continuous casting installation for casting a strand moving in a predetermined direction of travel along at least one guide path for the strand, a common pivotable yoke, two successive rollers following one another in the direction of travel of the strand located at the region of the at least one guide path in said common pivotable yoke, piston-cylinder means for moving said yoke substantially transversely with respect to a surface of the strand guided by said rollers, said yoke being provided with impact surfaces, support surfaces associated with each roller, a stationary frame, said support surfaces being provided at the stationary frame and limiting the path of application of the rollers with respect to the strand, the yoke provided with the impact surfaces can be applied by the piston-cylinder means in the direction of the support surfaces limiting the path of application of the rollers with respect to the strand.

2. The roller apron framework as defined in claim 1, including a further yoke provided with rollers and arranged opposite said yoke, said further yoke being arranged at the region of a further guide path for the strand, said two guide paths being situated opposite one another, said two yokes being situated opposite one another at said opposite guide paths, each of said rollers being connected with the associated yoke by laterally arranged bearings, and means for hingedly connecting said two yokes at both sides of said laterally arranged bearings with the piston cylinder means.

3. The roller apron framework as defined in claim 2, further including exchangeble intermediate elements disposed between the support surfaces and the impact surfaces for determining the spacing of the guide paths from one another.

4. The roller apron framework as defined in claim 2, further including a sliding block guided in the frame transversely with respect to the guide paths, said sliding block being disposed between the rollers of said two yokes and being pivotably connected with the roller bearings.

5. The roller apron framework as defined in claim 1, further including guide means provided at the stationary frame and cooperating with the yoke, said guide means limiting tilting movement of the yoke upon opening of the framework.

6. The roller apron framework as defined in claim 1, wherein the central axis of each of the rollers which extends transversely with respect to the guide path and the central axis of each of the associated impact surfaces extending in the same direction are substantially located in a common plane.

7. The roller apron framework as defined in claim 1, wherein the support surfaces are substantially arcuate-shaped.

8. The roller apron framework as defined in claim 1, wherein the impact surfaces are substantially arcuate-shaped.

* * * * *